US006761778B2

(12) United States Patent
Mignard et al.

(10) Patent No.: US 6,761,778 B2
(45) Date of Patent: Jul. 13, 2004

(54) HEATING PROCESS OF STEEL STRIPS IN VERTICAL FURNACES

(75) Inventors: François Mignard, Mennecy (FR); Patrick Dubois, Andrezel (FR)

(73) Assignee: Stein Heurtey (FR)

( * ) Notice: Subject to any disclaimer, the term of this patent is extended or adjusted under 35 U.S.C. 154(b) by 178 days.

(21) Appl. No.: 10/058,272

(22) Filed: Jan. 30, 2002

(65) Prior Publication Data

US 2002/0104598 A1 Aug. 8, 2002

(30) Foreign Application Priority Data

Jan. 31, 2001 (FR) ..... 01 01331

(51) Int. Cl.[7] ..... C21D 9/46; F27B 9/28

(52) U.S. Cl. ..... 148/511; 148/559; 432/8; 432/18; 432/20

(58) Field of Search ..... 148/511, 559, 148/565; 432/8, 18, 20

(56) References Cited

U.S. PATENT DOCUMENTS 3,610,592 A * 10/1971 Murray ..... 263/3
4,316,717 A * 2/1982 Thome ..... 432/8
4,494,929 A * 1/1985 Fujioka et al. ..... 432/59
4,691,898 A * 9/1987 Imose ..... 266/89
5,798,007 A * 8/1998 Boyer et al. ..... 148/627
6,238,209 B1 * 5/2001 Iida ..... 432/59

FOREIGN PATENT DOCUMENTS

| | | |
|---|---|---|
| EP | 0216561 A2 * | 4/1987 |
| EP | 0545768 | 6/1993 |
| FR | 2212916 | 7/1974 |
| JP | 57079123 | 5/1982 |
| JP | 57110624 | 7/1982 |
| JP | 09256075 | 9/1997 |

OTHER PUBLICATIONS

French Preliminary Search Report No. FA 598168; FR 0101331, pp. 1–2.

* cited by examiner

*Primary Examiner*—Daniel Jenkins
(74) *Attorney, Agent, or Firm*—Connolly Bove Lodge & Hutz LLP

(57) ABSTRACT

Method of reducing the wrinkles formed in heating zones, by radiant tubes, of continuous heat treatment lines for metal strip, such as annealing or galvanizing lines, the said strip passing over transporting and/or return rollers in the said furnaces, the said method, which consists in modifying the thermal state of the rollers, being characterized in that the said modification is made directly by varying the heating by the said radiant tubes located near the rollers, thereby directly controlling the heat flux emitted by the radiant tubes towards the rollers.

5 Claims, 3 Drawing Sheets

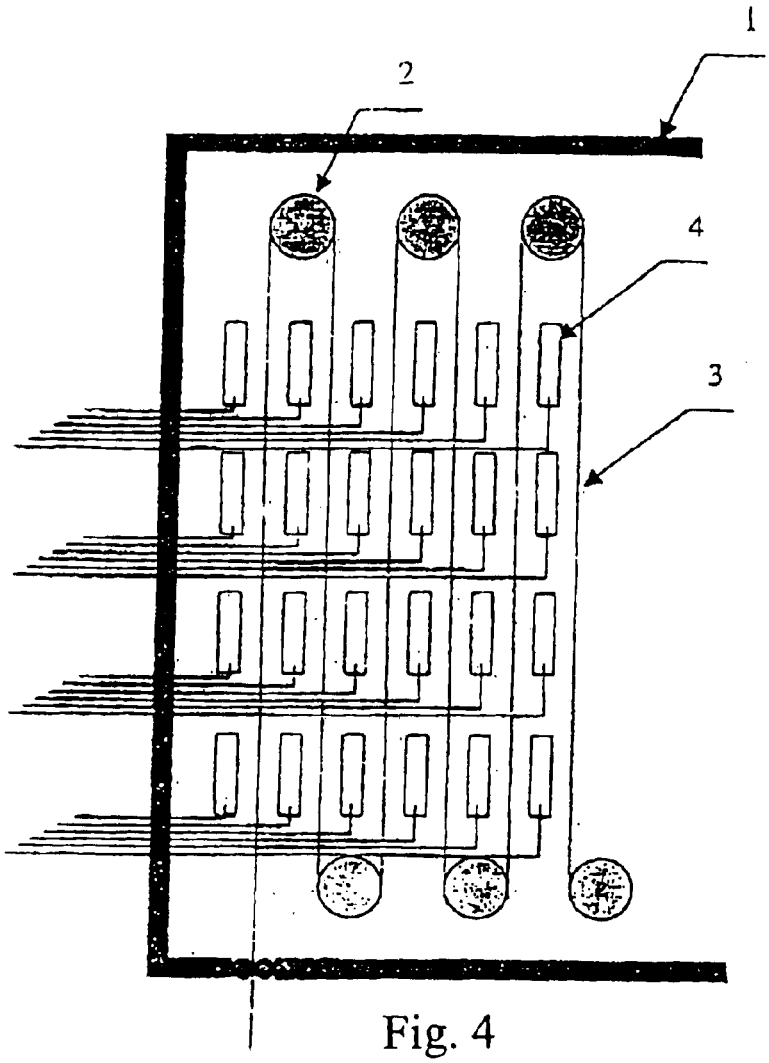
Fig. 4
Fig. 5
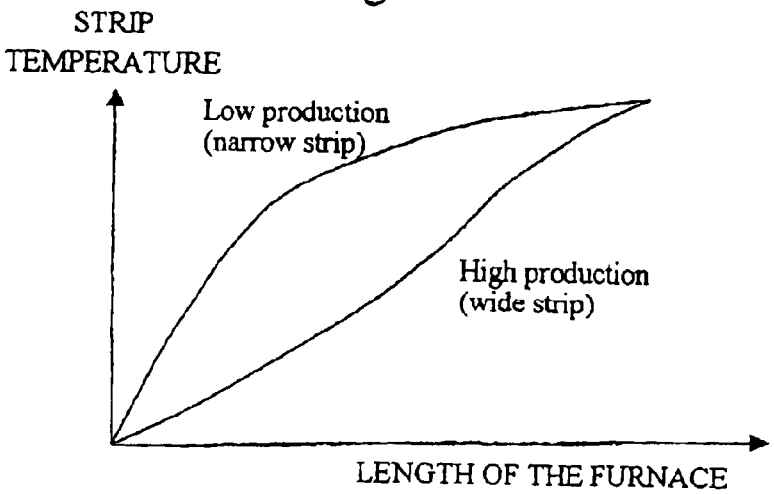

HEATING PROCESS OF STEEL STRIPS IN VERTICAL FURNACES

FIELD OF THE INVENTION

The subject of the present invention is improvements made to methods of heating steel strip in vertical furnaces and it relates more particularly to continuous vertical heat treatment lines for steel strip, such as annealing or galvanizing lines.

BACKGROUND OF THE INVENTION

The technical problem that the present invention aims to solve is that of limiting the formation of steel strip wrinkles in the heating sections of these vertical treatment lines using radiant tubes.

In order to make, on the one hand, the field of application of the invention, and on the other hand, the technical problem that it intends to solve more clearly understood, the current prior art in the field of vertical furnaces will be recalled with reference to FIG. 1, which is a schematic representation of such a strip treatment furnace.

In this figure, the reference 1 denotes the furnace according to the prior art, through which the metal strip 3 to be treated runs continuously, this strip passing over successive transporting rollers or return rollers denoted by the reference 2. The strip is heated by radiation using radiant tubes, such as 4, which are supplied with combustion air and with fuel (in general gas) via zones 5, which are generally vertical.

Each zone, such as 5, corresponds to a thermal sectioning of the furnace, which generally does not correspond physically to a specific chamber of the furnace. Each zone forms an inseparable group of radiant tubes 4 which are equipped with burners having a common fuel supply and a common combustion air supply. The heat demand of the furnace is therefore reflected in one fuel/combustion-air flow rate setting per zone, each zone having its own regulating system. In this method of operation, all the burners of the same zone operate in an identical manner, given that they are all supplied with the same fuel/combustion-air flow rate.

As the strip 3 passes through the furnace, it is heated on both its sides by the radiant tubes lying on each side of the pass line, and it changes line when it goes over each of the return or transporting rollers such as 2. The heating curve for the strip in the furnace is therefore controlled by the indexation of the various zones, for example six indexations when the furnace has six zones such as 5.

Within the chamber of the furnace 1, there is a temperature difference between the strip 3, which is cold, and the rollers 2, which are hot. When the strip 3 passes over the rollers 2, it cools them by contact over a region which corresponds to its width. This effect is, of course, more pronounced in the case of the first rollers. The temperature distribution along the longitudinal axis of the roller then follows a curve in the shape of a cup, as illustrated in FIG. 2 of the appended drawings. As a result of this temperature distribution, the roller table follows a curve of identical shape, due to the effect of thermal contraction. FIG. 3 shows the variation in diameter of the roller due to this thermal contraction along the longitudinal axis of the roller. The latter tries to adopt the shape of a "diabolo", something which must at all costs be avoided as the strip is then no longer guided at the centre of the roller and is then in an unstable position; it will therefore be difficult subsequently to re-centre it in the treatment line, even using guide rollers.

To avoid this phenomenon, the rollers are given an initial crown which is sufficient to maintain a very slight crown after the thermal contraction of the roller due to contact with the strip.

When a change of strip format is made, for example when going from a narrow strip to a wide strip, the latter will follow the cup shape of the roller instead of remaining plane. As a result, there is a risk of wrinkle formation, commonly called "heat buckle".

Moreover, the profile of the roller is optimized for a given strip width, particularly the flat length of the table. A strip greater in width will see a large crown, this being favourable to guiding but unfavourable in terms of the risk of wrinkle formation.

Although these wrinkling problems are not new, they are at the present time becoming more and more critical and frequent, especially for the following reasons:

- the formats of strip to be treated are moving towards greater widths. Sheet 2 m in width is commonplace, whereas it rarely exceeded 1.3 to 1.5 m a few years ago. Moreover, the improvement in the final mechanical properties of steel has allowed its thickness to be decreased, resulting in a reduction in weight. Overall, the width/thickness ratio has therefore increased considerably, hence a greater sensitivity to wrinkle formation;
- likewise, the appearance of modern grades of low-carbon steel, in particular the widespread use of interstitial-free steel, requires, in order for such steel to be drawable, annealing at higher temperature, at which the yield strength of the strip is lower. This reduction in mechanical strength further accentuates the risk of wrinkle formations;
- the increase in line speeds makes it more difficult to control the behaviour of the strip in the furnace; and
- the requirements on the running of production lines and the broadening of the "book" increases transients both in terms of thickness and width.

Controlling the flatness of the steel strip in the furnace therefore requires the transporting or return rollers to have good longitudinal temperature homogeneity, in the steady state and, above all, during strip format changes. At the present time there are solutions for solving this problem, among which the following may be mentioned:

- in-furnace wrinkling detection, associated with reduction in the line speed. This technique has the drawback of incurring a loss of production;
- increasing the strip tension: this method merely results in flatness defects being accentuated, since there is a risk of the strip deforming plastically;
- modification of the rollers themselves (for example, JP-A-04-06733), but this technique is very expensive and difficult to implement at high speed; and
- fitting of heat shields, whether fixed or moving, interposed between the edges of each roller and the radiant tubes of the furnace (see, for example, JP-A-06-228659), with the optional use of a curtain of atmosphere gas (JP-A-02-282431) or of heating elements (JP-A-63-038532). Admittedly this technique makes it possible to vary the thermal aspect of the roller, but it does require the use of equipment which is complex and relatively expensive both in terms of investment and maintenance. This is because the shields alone are not sufficient and they remain passive actuators.

BRIEF DESCRIPTION OF THE INVENTION

The objective of the present invention was to avoid the drawbacks of the methods according to the prior art by providing an economic and effective solution to this problem of wrinkle formation in vertical treatment furnaces for steel strip. Taking the opposite view for the solutions according to the prior art, the invention aims not to correct the thermal effects of the furnace on the transporting or return rollers by superposing additional actuators, but to act on the source by directly controlling the heat flux emitted by the heating system, while keeping the initial method.

Consequently, the invention relates to a method of reducing the steel strip wrinkles formed in heating zones, by radiant tubes, of continuous heat treatment lines for metal strip, such as annealing or galvanizing lines, the said strip passing over transporting and/or return rollers in the said furnaces, the said method, which consists in modifying the thermal state of the rollers, being characterized in that the said modification is made directly by varying the heating by the said radiant tubes located near the rollers, thereby directly controlling the heat flux emitted by the radiant tubes towards the rollers.

According to one way of implementing this method, each radiant tube is supplied separately and independently with combustion air and with fuel and the flow rate of fuel for each radiant tube is continuously adjusted.

According to another way of implementing the method forming the subject-matter of the invention, the heating by the radiant tubes is varied so as to reduce, or even eliminate, the thermal gradient in the furnace between the bottom rollers and the top rollers of the latter.

The invention may furthermore provide programmed management of the strip-heating curves, tailored to the strip formats and to the steady-state heat cycles during the transient phases.

Further features and advantages of the present invention will become apparent from the description given below, with reference to the appended drawings which illustrate an example of its implementation, but which is devoid of any limiting character. In the drawings:

BRIEF DESCRIPTION OF THE FIGURES

FIG. 4 is a schematic representation of a furnace implementing the method forming the subject-matter of the invention; and FIG. 5 shows the curves of the temperature rise of the strip along the furnace, on the one hand, for a low production (narrow strip) and, on the other hand, for a high production (wide strip).

DETAILED DESCRIPTION OF THE INVENTION

Figure 1:
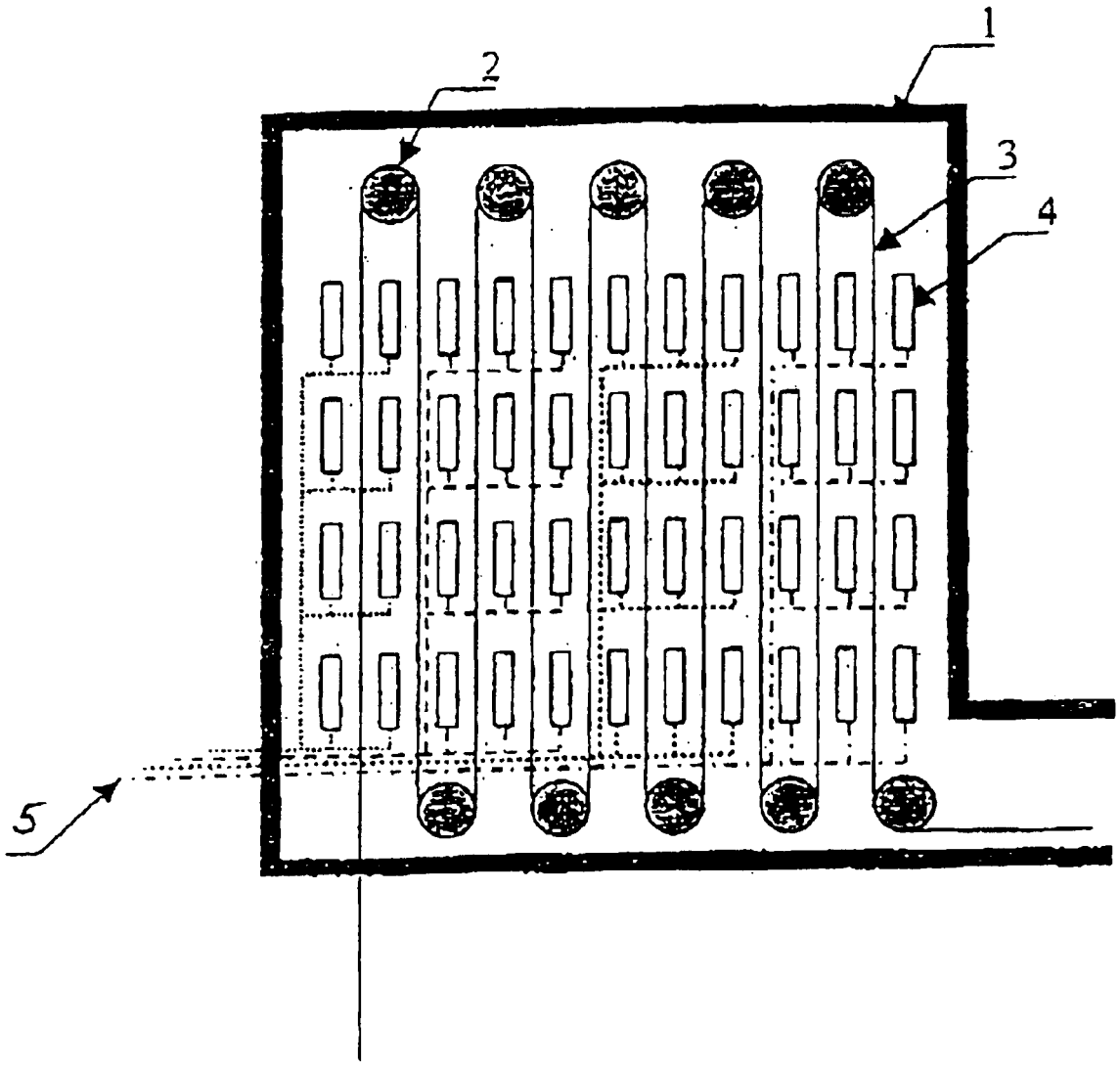
Fig. 1 Prior Art
FIG. 1 is a schematic representation of a furnace according to the prior art described above.
Figure 2:
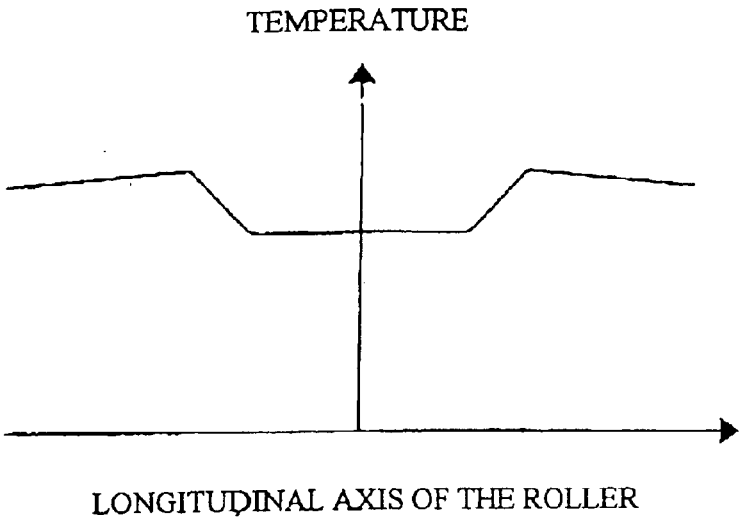
Fig. 2 Prior Art
FIG. 2 shows the temperature distribution along the longitudinal axis of the roller in a furnace according to FIG. 1.
Figure 3:
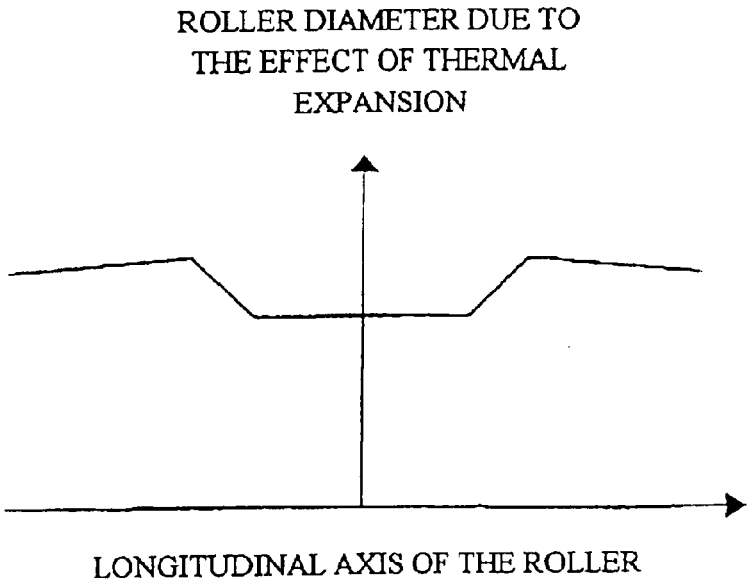
Fig. 3 Prior Art
FIG. 3 shows the variation in the diameter of the roller along its longitudinal axis, in a furnace according to FIG. 1.

FIG. 4, which shows a furnace 1 implementing the method of the invention, shows that the strip 3 travels continuously through the furnace passing over transporting or return rollers such as 2 and is heated by radiant tubes shown schematically at 4. According to one feature of the present invention each radiant tube is provided with an independent supply of fuel and combustion air so as to be able to directly control the heat flux emitted by the radiant tubes 4 towards the rollers such as 2. Thus, according to the method of the invention, the heat flux emitted by the radiant tubes is controlled separately, and not by zones as is the case in the prior art discussed above and illustrated by FIG. 1.

For running cost reasons, it is not essential for there to be continuous adjustment of the fuel flow rate for each radiant tube, it being possible for an operation of the "on/off" type to be perfectly suitable for implementing the method forming the subject-matter of the invention.

By way of illustration, a few examples of ways of implementing the method forming the subject-matter of the invention will be given below. Of course, these are merely examples, having no limiting character.

EXAMPLE 1

To facilitate a transition in strip width from the narrow type to the wide type, certain radiant tubes, in particular those close to the rollers, and only these or certain of them, are stopped in an anticipatory manner. This method of implementation makes it possible to limit the overall thermal crown of the roller.

EXAMPLE 2

To avoid wrinkle formation over a wide strip, it is important to maintain as flat a roller profile as possible at the point where the strip is hottest. According to the present invention, the highest possible radiant tube temperature is maintained in those parts of the furnace which are located downstream (greater expansion of the roller along its edges). A more rapid rise in strip temperature will therefore be sought in low production (see FIG. 5).

EXAMPLE 3

To avoid strip misalignment on narrow strip, the crown of the roller is accentuated, according to the invention, by maintaining a low radiant tube temperature (or by interrupting the supply to these tubes) at the point where the roller profiles are flattest.

EXAMPLE 4

In transitions, it is possible, according to the invention, by anticipation, to cool certain radiant tubes, and not others, by leaving the air valve open (hot-cold regulation).

The advantages offered by the present invention are especially the following:

- reduction in the risk of wrinkle formation, particularly during width transitions;
- possibility of varying the strip heating curve, taking into account the limitations due to wrinkles in addition to the usual limitations due to heat transfer towards the strip;
- possibility of eliminating the thermal gradient in the furnace; this is because it is well known that the upper part of the furnace is hotter than its lower part, because of convection favouring a chimney effect. Elimination of the thermal gradient results in a limitation of the thermal stresses experienced by the upper rollers and of the thermomechanical stresses experienced by the strip in contact with the rollers;
- increase in programming flexibility of the line, thanks to better passage of transients; and
- increased productivity of the line.

Of course, the present invention is not limited to the illustrative examples described and shown above, rather it encompasses all the variants thereof.

What is claimed is:

1. A method of reducing the wrinkles formed in a metal strip subjected to heat from radiant tubes in heating zones of a furnace, during continuous heat treatment of the metal strip, the strip passing over rollers in the furnace, the method comprising the steps:

modifying the thermal state of the rollers, wherein modifications are made directly by varying the heating by the radiant tubes located near the rollers, thereby directly controlling the heat flux emitted by the radiant tubes towards the rollers;

wherein each radiant tube is supplied separately and independently with combustion air and with fuel and the flow rate of fuel for each radiant tube is continuously adjusted.

2. Method according to claim 1, wherein the radiant tubes close to the rollers are stopped, in an anticipatory manner, so as to facilitate a strip width transition from a narrow type to a wide type.

3. Method according to claim 1, wherein in the case of a wide strip, the highest possible radiant tube temperature is maintained in those parts of the furnace which are located downstream.

4. Method according to claim 1, wherein, in the case of a narrow strip, a low radiant tube temperature is maintained.

5. Method according to claim 1, further including programmed management of the strip-heating curves, which is tailored to strip formats and to heat cycles, in both the steady state and transient phases.

* * * * *